United States Patent [19]

Clauss et al.

[11] 4,002,543

[45] Jan. 11, 1977

[54] ELECTRODEPOSITION OF BRIGHT NICKEL-IRON DEPOSITS

[75] Inventors: Richard John Clauss, Allen Park; Robert Arnold Tremmel, Woodhaven, both of Mich.

[73] Assignee: Oxy Metal Industries Corporation, Warren, Mich.

[22] Filed: May 6, 1975

[21] Appl. No.: 575,092

Related U.S. Application Data

[63] Continuation-in-part of Ser. No. 456,032, April 1, 1974, abandoned.

[52] U.S. Cl. ..... 204/41; 204/43 T

[51] Int. Cl.[2] ..... C25D 3/56; C25D 5/12

[58] Field of Search ..... 204/43 T, 43 N, 43 P, 204/41; 427/438; 106/1

[56] References Cited

UNITED STATES PATENTS

| | | | |
|---|---|---|---|
| 2,782,154 | 2/1957 | DuRose et al. | 204/49 |
| 2,836,549 | 5/1958 | Nobel et al. | 204/49 |
| 3,812,566 | 5/1974 | Clauss | 204/43 T X |

*Primary Examiner*—G. L. Kaplan
*Attorney, Agent, or Firm*—B. F. Claeboe

[57] ABSTRACT

The instant invention is directed to an aqueous bath for the electrodeposition of a bright iron-nickel alloy and to a process utilizing the same, the bath comprising iron ions, nickel ions, an iron complexing agent containing at least two complexing groups independently selected from the group consisting of carboxy and hydroxy provided at least one group is a carboxy group, and a reaction product of a polyamine and an alkylating or sulfonating agent, whereby there is achieved a marked improvement in the brightness of the electrodeposit as well as excellent leveling in both the high and low current density areas. Optionally, by the addition of acetylenic brighteners of a particular structural formula even further improved results may be obtained.

15 Claims, No Drawings

ELECTRODEPOSITION OF BRIGHT NICKEL-IRON DEPOSITS

CROSS REFERENCE TO RELATED CASES:

This case is a continuation-in-part of U.S. Ser. No. 456,032, filed Apr. 1, 1974 and now abandoned.

BACKGROUND OF THE INVENTION

It is known in the art to which this invention pertains to electrodeposit nickel as a substrate for the subsequent electrodeposition of chromium in order to impart to a metallic surface satisfactory corrosion resistant properties. It has been proposed primarily for the purposes of improving the brightness of platings made from conventional nickel baths to use addition agents which are the reaction products of polyamines and unsaturated or acetylenic compounds typified by propargyl alcohol. Representative of this state of the art is U.S. Pat. No. 2,836,549, and generally related thereto is U.S. Pat. No. 2,782,154.

However, applicants have found that these generalized teachings of the prior art are not applicable in the area of iron-nickel electrodeposition, and in many cases produce on the basis metal deposits unacceptable as to their leveling properties, or do not possess the requisite degree of brightness.

SUMMARY OF THE INVENTION

It has been found that by proceeding in accordance with the present inventive concepts bright iron-nickel alloy deposits can be obtained which are comparable to 100% nickel deposits in brightness, leveling and ductility with good corrosion resistant properties as a substrate for chromium electrodeposition. The iron-nickel alloy bath contains ions of iron and ions of nickel, an iron complexing agent containing complexing groups such as carboxy and hydroxy groups, and a reaction product of a polyamine in which the repeat polymer unit is thought to be $$(-[CH_2]-\overset{H}{\overset{|}{N}}-)$$

having a molecular weight of 300 to 24,000 and an alkylating or sulfonating agent, wherein the mol ratio of the alkylating or sulfonating agent to the repeat polymer unit varies from about 2 to 1 to approximately 1 to 1. If desired, the bath may further include a water soluble acetylenic nickel brightener having the general formula $HC \equiv C - CH_2 - X$ which will be hereinafter defined in further detail.

DESCRIPTION OF THE PREFERRED EMBODIMENT

Applicants' invention is directed to the electrodeposition of a bright iron-nickel alloy deposit of from 5 to 50% by weight iron preferably about 15 to about 35% by weight which can be used as the basis for subsequent electrodeposition of chromium in order to impart desirable decorative and/or corrosion resistant properties to substrates, such as metallic substrates.

The bath and process of the present invention can also be used in the electrodeposition of a nickel-iron alloy for plastics. Normally the plastic substrate such as acrylonitrile-butadiene-styrene, polyethylene, polypropylene, polyvinyl chloride, phenol-formaldehyde polymers and the like is pretreated by applying a conductive metallic deposit such as nickel or copper onto the plastic substrate. The iron-nickel deposit may then be used as a subsequent coating upon the conductive metallic deposit.

In order to introduce iron and nickel ions into the bath, any bath soluble iron or nickel containing compound may be employed provided that the corresponding anion is not detrimental to the bath. Preferably inorganic nickel salts are employed, such as, nickel sulfate, nickel chloride, and the like as well as other nickel materials such as nickel sulfamate. When nickel sulfate salts are used they are normally present in amounts ranging from 40 to 300 grams per liter (calculated as nickel sulfate $6H_2O$); nickel chloride may also be used and is present in an amount ranging from about 80 to 250 grams per liter. The chloride or halide ions are employed in order to obtain satisfactory conductivity of the solution and at the same time to impart satisfactory corrosion properties to the soluble anodes.

Preferably the inorganic salts of iron are employed, such as, ferrous salts exemplified by ferrous sulfate, ferrous chloride and the like. These salts are preferably present in an amount ranging from about 3 to 60 grams per liter. Other bath soluble iron salts may be employed, as for example soluble ferrous fluoborate or sulfamate.

The iron complexing agent employed in the present invention is one that is bath soluble and contains complexing groups independently selected from the group consisting of carboxy and hydroxy provided at least one of the complexing groups is a carboxy group and further provided that there are at least two complexing groups. The complexing agent that may be employed is present in an amount ranging from about 10 to about 100 grams per liter. Suitable complexing agents are hydroxy substituted lower aliphatic carboxylic acids having from 2 to 8 carbon atoms, from 1 to 6 hydroxyl groups and from 1 to 3 carboxyl groups such as, ascorbic acid, isoascorbic acid, citric acid, malic acid, glutaric acid, gluconic acid, muconic, glutamic, glucoheptonate, glycollic acid, aspartic acid and the like as well as amine containing complexing agents, such as nitrilotriacetic acid, ethylene diamine tetra-acetic acid, or the water soluble salts thereof such as ammonium and the alkali metal salts such as potassium, sodium, lithium, and the like. It can also be appreciated that the iron may be introduced into the bath as a salt of the complexing agent.

By "carboxy" is meant the group —COOH. However, it is to be appreciated that in solution, the proton disassociates from the carboxy group and therefore this group is to be included in the meaning of carboxy.

The purpose of the complexing agent is to keep the metal ions, in particular, the ferrous and ferric ions in solution. It has been found that as the pH of a normal Watts nickel plating bath increases above a pH of 3.0, ferric ions tend to precipitate as ferric hydroxide. The complexing agent prevents the precipitation from taking place and therefore makes the iron and nickel ions available for electrodeposition from the complexing agent.

While the iron is always introduced as the ferrous salt, it has been established that a portion of the iron in solution is almost always oxidized from the ferrous to ferric state. The concentration of ferric ion in solution is determined by a number of factors, and particularly by the operating pH of the solution. The type and amount of anode area in the solution will also affect the relative concentration of ferric ion. We believe this may be due to the oxidizing of ferrous to ferric ion at the anode. Generally speaking, it is found that at least 5% of the total iron in solution is present as ferric ions, and it is preferred that the ferric ion not exceed 30 to 40% of the total iron in the bath, although it has been established in work performed to date that acceptable results may be obtained when even as much as 60% of the iron in the solution is present as ferric ions. It has been observed that the relative concentration of ferric ion will be higher in an air agitated solution than one that is dependent on only cathode agitation. The exact structure which is formed by the interaction of the ferric ion with the complexing agent is not presently precisely known. The literature reports a number of possible structures under different conditions; for instance, the structure reported in water solution may be different from that determined in biological applications. We also have reason to believe that the structure in a plating solution changes during electrolysis. Regardless of the exact structure, the ferric ion is not precipitated from the solution, as the hydroxide, even at a pH of 5.

Because of the operating parameters employing the complexing agent, the pH of the bath preferably ranges from about 2.5 to about 5.5 and even more preferably about 3 to about 4.6. The temperature of the bath generally ranges from about 120° F to about 180° F, preferably about 160° F. The average cathode current density varies from about 10 to about 70 amps per square foot and preferably about 45 amps per square foot. While the bath may be operated without agitation, various means of agitation may be employed such as mechanical agitation, air agitation, cathode rod movement and the like.

It is preferred that the complexing agent concentration be at least three times the total iron ion concentration in the bath. The complexing agent concentration ratio to total iron ion concentration may range from about 3 to 50 to 1.

The bath may also contain various buffers such as boric acid and sodium acetate and the like ranging in amounts from about 30 to 60 grams per liter, preferably 40 grams per liter. The ratio of nickel ions to iron ions ranges from about 5 to about 50 to 1.

It has been found that various nickel brightening additives may be employed to impart brightness, ductility and leveling to the iron nickel deposits. Suitable additives which may be used are the sulfo oxygen compounds such as are described as brighteners of the first class described in *Modern Electroplating*, published by John Wiley and Sons, second edition, p. 272.

The amount of sulfo-oxygen compounds employed in the present invention may range from about 0.5 to about 10 grams per liter. It has been found that saccharin may be used in amounts ranging from 0.5 to about 5 grams per liter and which results in a bright ductile deposit. When other sulfo-oxygen compounds are employed, such as, naphthlenetrisulfonic, sulfobenzaldehyde, dibenzenesulfonamide, good brightness is obtained; however, the ductility is not as good as with saccharin. In addition to the above sulfo-oxygen compounds that may be used, others which are suitable are sodium allyl sulfonate, benzene sulfinates, vinyl sulfonate, beta-styrene sulfonate, and cyano alkane sulfonates (having from 1 to 5 carbon atoms).

The bath soluble sulfo-oxygen compound that may be used in the present invention are those such as the unsaturated aliphatic sulfonic acids, mononuclear and binuclear aromatic sulfonic acids, mononuclear aromatic sulfinic cids, mononuclear aromatic sulfonamides and sulfonimides, and the like.

As was earlier pointed out, it has been discovered that an iron-nickel alloy electrodeposit of marked superiority from the standpoint of brightness, leveling, ductility and other properties can be achieved when there is added to the aqueous bath comprising iron and nickel ions and an iron complexing agent the reaction product of a polyamine type brightener which has a molecular weight ranging from 300 to about 24,000, and in accordance with this invention, exemplary alkylating agents are dimethyl sulfate, chloroacetic acid, allyl bromide, propane sultone, benzyl chloride or propargyl bromide. Other compounds are of course suitable for effecting the purposes of the present invention; however, the generic grouping of alkylating agents can be structurally represented by the following formula:

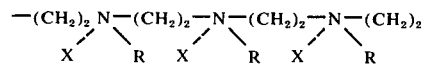

wherein R equals alkyl, alkene, alkyne or an aromatic radical containing up to 8 carbon atoms.

It is desired to point out in this connection that the ratio of the reactants — polyamine to alkylating agent — may be varied so that every amino group need not necessarily be alkylated.

Also in accordance with this invention, the polyamine may be sulfonated utilizing as exemplary compounds sulfamic acid, chloro sulfonic acid and the like. This reaction results in a compound which may be represented by the following structural formula:

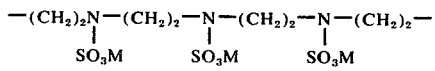

wherein M may be hydrogen, ammonium, sodium, potassium, or lithium.

Again, the ratio of polyamine to sulfonating agent may be varied so that every amino group need not be sulfonated.

A compound having the structural formula set forth above was prepared in the following manner. A 500 ml 4 neck round bottomed flask was fitted with a stirrer, additional funnel, thermometer and a 150 mm column leading to a calcium chloride drying tube. In the flask there was placed 200 ml dry dioxane and the flask was then cooled to zero degrees in a ice-brine bath. 10 ml (approximately 0.1 mole) of chlorosulfonic acid was added through the addition funnel while keeping the temperature to below 10°. After the addition was completed, the funnel was cleaned and dried. Thereafter, a suspension of 4.3 g (0.1 mole/unit) polyethylene imine in 100 gl dry dioxane was added through the addition funnel keeping the temperature below 10°. The flask was warmed to 70 degrees, and the acid decanted off. The white polymeric residue (sulfonated polyethylenimine) was washed with ether and then dissolved in 100 ml water. The resultant product was a white hygroscopic polymer and the yield was 100 percent.

To illustrate the invention futher, a number of examples will be given generally utilizing a nominal solution composition as follows:

| | |
|---|---|
| $NiSO_4 \cdot 6H_2O$ | 75 g/l |
| $NiCl_2 \cdot 6H_2O$ | 75 g/l |
| $H_3BO_3$ | 45 g/l |
| $FeSO_4 \cdot 7H_2O$ | 10 g/l |
| $C_3H_6(OH)_5COONa$ | 14 g/l |
| $C_3H_4(OH)(COONa)_3$ | 6 g/l |
| Saccharin | 3 g/l |
| Sodium allyl sulfonate | 4.5 g/l |
| pH | 3.4 |
| Temperature | 150° F |
| Air Agitation | |

EXAMPLE I

To the nominal solution composition set forth above there was added a polyamine having a molecular weight of about 600 which has been reacted with propane sultone. This reaction product when added at a concentration range of approximately 2 to 12 milligrams per liter produced a deposit having exceptionally good brightness and leveling.

EXAMPLE II

To the nominal bath solution set forth above, there was added a compound, obtained by reacting a polyamine having a molecular weight of about 1200 with sulfamic acid, at a concentration of about 0.8 milligrams per liter, together with approximately 45 milligrams per liter of 2-propynoxy ethanol. Again, excellent brightness and leveling were obtained in the nickel-iron deposit.

EXAMPLE III

Another nickel-iron plating bath was made up as follows:

| | |
|---|---|
| $NiSO_4 \cdot 6H_2O$ | 120 g/l |
| $NiCl_2 \cdot 6H_2O$ | 75 g/l |
| $H_3BO_3$ | 40 g/l |
| $FeSO_4 \cdot 7H_2O$ | 15 g/l |
| Isoascorbic acid | 20 g/l |
| Saccharin | 3 g/l |
| Sodium allyl sulfonate | 6 g/l |
| pH | 3.3 |
| Temperature | 140° F |
| Air Agitation | |

To the above described bath was added the reaction product of polyethylene imine (molecular weight 1200) and sulfamic acid at a concentration of 1.0 mg/l, together with 45 mg/l of 2 propynoxy ethanol.

Steel panels plated at 45 ASF for 10 minutes were exceptionally bright with excellent leveling.

To another bath comparable in composition to the one described above was added a polyamine having a molecular weight of 1200 which had been reacted with sulfamic acid. Panels were plated at 2,4 and 8 mg/l concentrations of this material. Results indicated that the panels became brighter and more leveled as the concentration increased, so that exceptional brightness and leveling were obtained at the 8 mg/l concentration.

In order to demonstrate the markedly improved results obtained when the reaction products herein disclosed are utilized in a typical Watts nickel bath and the nickel-iron bath which comprises nickel and iron ions and the iron complexing agent disclosed in Examples I, and II, baths were formulated in which both the Watts and nickel-iron formulations were utilized with agitation at 145° F. To each solution there was added 2 grams per liter of saccharin and 4 grams per liter of allyl sulfonate. Steel panels were plated in each solution at 45 ASF for 10 minutes at various concentrations of the reaction product of polyethylenimine, having a molecular weight of about 1200, and propargyl epichlorohydrin.

In the Watts nickel bath the polyethylenimine-propargyl adduct was varied in concentration from 2 milligrams per liter, 4 milligrams per liter, 8 milligrams per liter, 16 milligrams per liter and 25 milligrams per liter. At the lower concentrations of 2, 4 and 8 milligrams per liter the deposit was overall semi-bright with no leveling, while at concentrations of 16 and 25 milligrams per liter the deposit was lustrous with some slight leveling. However, when the mentioned nickel-iron bath was utilized, the addition of 2 milligrams per liter of the polyethylenimine propargyl adduct revealed a deposit which could be characterized as overall lustrous to bright with some leveling, the addition of 4 milligrams per liter gave an overall bright deposit with fair leveling, and when 8 milligrams per liter of the adduct was added marked improvements were noted in that the deposit was essentially totally bright and excellent leveling was obtained.

These same tests were repeated utilizing the propane sultone adduct of polyethylenimine at a molecular weight of about 1800. With the Watts nickel bath additions of the mentioned adduct at concentrations of 2, 4 12 and 24 milligrams per liter produced only an overall semi-bright deposit with essentially no leveling. Quite by contrast, in the disclosed nickel-iron bath previously described, when 2 milligrams per liter of the polyethylenimine propane sultone adduct was added, the deposit was lustrous to bright with some leveling, 4 milligrams per liter produced an overall bright deposit with rather fair leveling, 8 milligrams per liter gave an overall bright deposit with good leveling, and when 12 milligrams per liter of the adduct was employed, the deposit was very bright and the leveling was excellent.

It would thus appear that the polyethylenimine derivatives have little or limited effectiveness in nickel plating solutions while deposits of great brightness and outstanding leveling can be obtained with these same compounds in nickel-iron solutions of the type described. As has also been pointed out in Example II, when propargyl alcohol derivatives are used in conjunction with polyethylenimine derivatives, particularly certain derivatives obtained by reaction with sulfamic acid, the low current density leveling is further improved, and as a result, exceptionally fine nickel-iron deposits are obtained with a level equally as good as, and in some cases, even exceeding what are recognized in the art to be the best bright nickel baths.

The secondary brighteners, or acetylenic nickel brighteners, are generically propargyl alcohol derivatives having the formula $CH \equiv C - CH_2 - X$ wherein X is essentially the reactive functional group. More particularly, the structural formula may be typified as follows:

$$HC \equiv C - CH_2 - X$$

-continued wherein X may be $OR_1$, or $N\begin{matrix}R_2\\R_3\end{matrix}$

If X = $OR_1$, $R_1$ may be $(-CH_2-CH_2-O)_n$ or $R_1$ may be $(-CH_2-\underset{\underset{OH}{|}}{\overset{\overset{CH_2OH}{|}}{C}})_n$ or $R_1$ may be $(-CH_2-\overset{\overset{CH_2Cl}{|}}{CH_2}-)_n$ or $R_1$ may be $(-CH_2-\underset{\underset{OH}{|}}{\overset{\overset{CH_2SO_3H(K^+,Li^+,Na^+,NH_4^+)\text{ and the like}}{|}}{C}})_n$ or $R_1$ may be $(-CH_2-\overset{\overset{OH}{|}}{CH}-CH_2-)_n$ or $R_1$ may be $(-CH_2-\underset{\underset{OH}{|}}{\overset{\overset{CH_2-N\begin{matrix}R_4\\R_5\end{matrix}}{|}}{C}}-)_n$ wherein $R_4$ or $R_5$ may be H, alkyl, alkene or alkyne groups of 1 to 4 carbon atoms;
wherein $n$ = 1 to 3; and if X = $N\begin{matrix}R_2\\R_3\end{matrix}$ $R_2$ or $R_3$ may be H, Alkyl, alkene or alkyne groups of 1 to 4 carbon atoms.

To further illustrate the invention, two stock solutions were prepared which are designated herein below as nickel bath A and nickel-iron bath B:

| | | |
|---|---|---|
| NICKEL BATH (A) | | |
| | Nickel Sulfate | 300 g/l |
| | Nickel Chloride | 45 g/l |
| | Boric Acid | 40 g/l |
| | Saccharin | 3.0 g/l |
| | Allyl Sulfonate | 4.5 g/l |
| | pH | 3.8 |
| NICKEL BATH (B) | | |
| | Nickel Sulfate | 108 g/l |
| | Nickel Chloride | 82 g/l |
| | Boric Acid | 44 g/l |
| | Gluconic Acid (Sodium Salt) | 25 g/l |
| | Ferrous Sulfate | 15 g/l |
| | Saccharin | 3.0 g/l |
| | Allyl Sulfonate | 4.5 g/l |
| | pH | 3.3 |

The nickel solution A was divided into several 600 cc air agitated plating cells and various propargyl alcohol derivatives were tested. Rolled steel cathode panels 1½ by 6" were used for the tests. Results are given in the following Table No. I. All panels were plated at 45 ASF for 10 minutes.

Solution B was also divided into several 600 cc air agitated plating cells and the tests were repeated. Results are given in Table No. II.

Another portion of plating solution B was placed in a liter air agitated plating cell. 2 by 9" S shaped steel cathode panels were used to determine the low current density leveling of the bath. The panels were plated at 35 ASF for 10 minutes. Results are given on Table No. III.

TABLE I

| COMPOUND TESTED | CONC. | SOLUTION A BATH TEMP. | RESULTS |
|---|---|---|---|
| 2-propynoxy ethanol | 20 mg/l | 145° F. | Bright leveled, striated deposit with a dark low current density area and poor adhesion. |
| 2-propynoxy ethanol | 40 mg/l | 145° F | Very bright leveled deposit with a black misplated low current density area; severe striations and exfoliation. |
| 2 hydroxy 3 propynoxy-1-propane sulfonate | 20 mg/l | 145° F | Bright fairly leveled deposit with low current density area striation. |
| 2 hydroxy 3 propynoxy-1-propane sulfonate | 40 mg/l | 145° F | Bright leveled deposit, striated and slight misplate in the low current density area. |
| 1-propynoxy-3-chloro-2-propanol | 80 mg/l | 145° F | Bright leveled deposit, severe striation, and a misplate in the low current density area. |
| 1-propynoxy-2-propanol | 20 mg/l | 145° F | Bright leveled, striated deposit with a dark low current density area. |
| 1-propynoxy-2-propanol | 40 mg/l | 145° F | Very bright leveled deposit with severe striations, poor adhesion, and a dark misplate |

TABLE I-continued

| COMPOUND TESTED | CONC. | SOLUTION A BATH TEMP. | RESULTS |
|---|---|---|---|
| | | | in the low current density area. |

TABLE II

| COMPOUND TESTED | CONC. | SOLUTION B BATH TEMP. | RESULTS |
|---|---|---|---|
| 2 propynoxy ethanol | 20 mg/l | 150° F | Bright leveled smooth deposit with an excellent low current density area. |
| 2-propynoxy ethanol | 40 mg/l | 150° F | Very bright leveled smooth deposit with an excellent low current density area. |
| 2 propynoxy ethanol | 80 mg/l | 150° F | Extremely bright leveled smooth deposit with an excellent low current density area. |
| 2 hydroxy 3 propynoxy-1-propane sulfonate | 40 mg/l | 150° F | Bright leveled smooth deposit with an excellent low current density area. |
| 1 propynoxy-3 chloro-2 propanol | 120 mg/l | 150° F | Very bright leveled smooth deposit with an excellent low current density area. |
| 1 propynoxy-2-propanol | 80 mg/l | 150° F | Extremely bright leveled smooth deposit with an excellent low current density area. |

TABLE III

| | COMPOUND TESTED | CONC. | BATH TEMP | RESULTS |
|---|---|---|---|---|
| (1) | 2 propynoxy ethanol | 60 mg/l | 150° F | Very bright and smooth with excellent overall leveling and good low current density area leveling. |
| (2) | as above with 0.4 mg/l of polyethyleneimine sulfamic acid reaction product | | | Same as above except that there was a noticeable improvement in the low current density area leveling. |

It would thus appear that when propargyl alcohol, and its derivatives, are used in simple nickel plating baths there is obtained to a degree good brightness and leveling, if used in combination with typical sulfo-oxygen "carrier type" brighteners. However, these compounds are rather critical with respect to concentration in that the amount needed in order to achieve even good brightness and leveling will produce dark recesses, skipped plate, poor adhesion and striated deposits. As a results, these compounds must be used in trace amounts of the order of 10 milligrams per liter or less in the nickel plating bath in combination with other less critical brightening agents, in order to minimize their adverse effects. However, limiting the concentration of these materials, their effectiveness with respect to leveling and brightness is markedly limited.

Quite by contrast, when these compounds are used in the disclosed iron-nickel plating bath their adverse effects are virtually non-existant even at extremely high concentrations. The test described indicated that as high as 80 milligrams per liter of the most critical derivative, that is, 2 propynoxy ethanol at a 1 to 1 mol ratio produces bright, uniform, and exceptional leveling with good adhesion and excellent recessed areas. As little as 15 milligrams per liter of this material in a bright nickel bath using the same sulfo-oxygen carriers produced striated deposits with dark skipped recess areas and poor adhesion.

Tests also indicated that as little as 20 mg/l of 2 propynoxy alcohol plus 0.13 mg/l of the reaction product of polyethylenimine (MW 1200) and sulfamic acid in a mol ratio of 1 to 14 in combination with saccharin and allyl sulfonate produced noticeably better overall brightness and leveling in bath B above described than bath A containing the maximum amount of secondary brightener addition agents as described in Table I.

It is believed manifest from the foregoing that applicants have provided a novel nickel-iron bath composition and method of electrodeposition which provides markedly improved results by way of brightness and excellent leveling in both the high and low current density areas. This is quite in contrast with the results obtained in a simple nickel bath such as is known to the prior art, typified by the disclosures in U.S. Pat. Nos. 2,782,154 and 2,836,549. While a number of variations in the formulae have been disclosed herein, these changes and others may of course be practiced without departing from the spirit of the invention or the scope of the subjoined claims.

What is claimed is:

1. An aqueous acidic bath suitable for the electrodeposition of a bright iron-nickel electrodeposit onto a substrate susceptable to corrosion, which comprises iron ions and nickel ions, the ratio of nickel ions to iron ions being from about 5 to about 50 to 1, about 0.5 to 10 g/l of an organic sulfo-oxygen compound, a bath soluble complexing agent in the amount of about 10 to 100 g/l which is a carboxylic acid having both carboxyl and hydroxyl groups and in addition, about 0.1 mg/l to 25 mg/l of a reaction product of a polyalkylene polyamine and an alkylating or sulfonating agent, said polyamine having a molecular weight of from about 300 to 24,000.

2. A bath as defined in claim 1, in which in the polyamine the repeat polymer unit is $$(-(CH_2)_2-\overset{H}{\overset{|}{N}}-)$$

and wherein the mol ratio of the alkylating agent or sulfonating agent to the repeat polymer unit varies from about 2 to 1 to about 1 to 1.

3. A bath as defined in claim 1, in which the alkylating or sulfonating agent is selected from the group consisting of dimethyl sulfate, sulfamic acid, chloroacetic acid, allyl bromide, propane sultone, benzyl chloride, propargyl bromide and chloro-sulfonic acid.

4. A bath as defined in claim 1, wherein the complexing agent is citric acid.

5. A bath as defined in claim 1, wherein the complexing agent is gluconic acid.

6. The bath of claim 1, wherein the sulfo-oxygen brightener is saccharin.

7. The bath of claim 1, further comprising an acetylenic nickel brightener present in an amount ranging from about 10 to 500 mg/l.

8. A process for producing a bright iron-nickel alloy electrodeposit comprising passing a current through the bath of claim 1 and electrodepositing an iron-nickel alloy onto a cathodic surface.

9. A process as defined in claim 8, wherein the complexing agent is citric acid.

10. A process as defined in claim 8, wherein the complexing agent is gluconic acid.

11. A process as defined in claim 8, wherein the sulfo-oxygen is saccharin.

12. A process as defined in claim 8, further comprising an acetylenic nickel brightener present in an amount ranging from about 10 to 500 mg/l.

13. A process for producing an iron-nickel alloy, chromium coated article comprising electrodepositing an iron nickel alloy onto a substrate in the bath of claim 1 and subsequently electrodepositing chromium upon the iron-nickel coating.

14. A process as defined in claim 13, in which in the polyamine the repeat polymer unit is $$(-(CH_2)_2-\overset{H}{\overset{|}{N}}-)$$

and wherein the mol ratio of the alkylating agent or sulfonating agent to the repeat unit varies from about 2 to 1 to about 1 to 1.

15. A process as defined in claim 13, in which the alkylating or sulfonating agent is selected from the group consisting of dimethyl, sulfate, sulfamic acid, chloroacetic acid, allyl bromide, propane sultone, benzyl chloride, propargyl bromide and chlorosulfonic acid.

* * * * *